US005920153A

United States Patent [19]

Falace et al.

[11] Patent Number: 5,920,153

[45] Date of Patent: Jul. 6, 1999

[54] POWER SUPPLY FOR LIGHT SOURCES, PARTICULARLY FOR THE QUICK IGNITION OF FLUORESCENT LAMPS AND THE LIKE

[75] Inventors: Lucio Falace, Naples; Rosario Tortora, Meta Di Sorrento, both of Italy

[73] Assignee: United Light Electronics Ltd., Douglas, United Kingdom

[21] Appl. No.: 08/913,787

[22] PCT Filed: Mar. 11, 1996

[86] PCT No.: PCT/EP96/01042

§ 371 Date: Sep. 19, 1997

§ 102(e) Date: Sep. 19, 1997

[87] PCT Pub. No.: WO96/29846

PCT Pub. Date: Sep. 26, 1996

[30] Foreign Application Priority Data

Mar. 22, 1995 [IT] Italy ..... NA95A0019

[51] Int. Cl.[6] ..... H05B 39/00

[52] U.S. Cl. ..... 315/94; 315/105; 315/273; 315/DIG. 5

[58] Field of Search ..... 315/94, 101, 102, 315/105, 273, 201, 200 R, DIG. 5, 205

[56] References Cited

U.S. PATENT DOCUMENTS

| | | | |
|---|---|---|---|
| 3,836,816 | 9/1974 | Heck | 315/94 |
| 3,890,539 | 6/1975 | Remery | 315/273 |
| 4,394,603 | 7/1983 | Widmayer | 315/311 |
| 5,444,333 | 8/1995 | Lau | 315/94 |

FOREIGN PATENT DOCUMENTS

| | | |
|---|---|---|
| A0650312 | 4/1995 | European Pat. Off. . |
| A2645393 | 10/1990 | France . |

*Primary Examiner*—Don Wong
*Assistant Examiner*—Haissa Philogene
*Attorney, Agent, or Firm*—Daniel J. O'Byrne

[57] ABSTRACT

A power supply for light sources, particularly for fluorescent lamps and the like, comprising capacitive means (1) that are connected to the mains (9) and are adapted to supply rectifier means (2) for rectifying the mains current from AC to DC; and filter means (6) that are connected in output to the rectifier means (2) and are adapted to filter the rectified current for supplying power to a fluorescent lamp (8).

11 Claims, 1 Drawing Sheet

POWER SUPPLY FOR LIGHT SOURCES, PARTICULARLY FOR THE QUICK IGNITION OF FLUORESCENT LAMPS AND THE LIKE

BACKGROUND OF THE INVENTION

The present invention relates to a power supply for light sources, particularly for the quick ignition of fluorescent lamps and the like.

A fluorescent lamp is constituted by a glass tube containing a small amount of mercury and argon, internally coated with phosphors, and provided, at its ends, with two electrodes, between which the potential difference required to trigger and maintain the discharge is established.

Each electrode is constituted by a tungsten filament.

The electrodes must usually be preheated to 1200 K. The ignition device must preheat the electrodes and produce the over-voltage required to trigger the discharge.

The ignition device comprises a starter and a ballast. When the mains voltage is applied, the discharge in the neon gas contained in the starter is triggered. The discharge in the starter then ends and the current flows into the filament of the fluorescent lamp. As a consequence of the opening of the contact inside the starter, and due to the considerable self-induction of the ballast, an over-voltage is produced which is capable of triggering the discharge in the fluorescent lamp, producing the arc. The steady-state voltage during the operation of the lamp is lower than the mains voltage and is not sufficient to maintain the discharge in the starter. Accordingly, the starter, after igniting the lamp, remains automatically open.

A drawback of this solution is the need to use a ballast and a starter, with consequent problems related to consumption, cost, and bulk.

The preheating of the electrodes furthermore requires a waiting time, and breakage of the internal filament of the lamp thus prevents its operation.

Finally, the inductive coefficient of the ballast causes a phase shift in the alternating current; if it is not adequately corrected, this shift overloads the circuits with current values that are sometimes twice those necessary. In this case it is therefore necessary to use a rephasing capacitor of adequate value that returns the current to the set values.

From EP-A-0650312 is known a device which makes use of an oscillator for the supply of the fluorescent tube after its ignition. This device makes also use of several rectifier-multiplier stages to increase the voltage for obtaining a high voltage to ignite the tube.

The presence of an oscillator makes the circuitry a complex one, the more so that an amplifier is also provided upstream of the voltage multiplier. The known circuitry provides in a specific complex way for keeping alight the tube and for igniting it.

From FR-A-2645393 is known another device for the ignition of a fluorescent tube, which uses a special circuitry for the polarity inversion of the supply voltage, to avoid the polarizing effect that would render the tube unusable after few hours. Again the circuitry is a complex one because of the need of a device for polarity inversion.

SUMMARY OF THE INVENTION

A principal aim of the present invention is therefore to provide a power supply for light sources, particularly for fluorescent lamps and the like, that allows to quickly ignite a fluorescent lamp.

Within the scope of this aim, an object of the present invention is to provide a power supply for light sources, particularly for fluorescent lamps and the like, that allows to eliminate the ballast, the starter, and the tungsten filaments inside a fluorescent lamp.

Another object of the present invention is to provide a power supply for light sources, particularly for fluorescent lamps and the like, that allows to eliminate the preheating of the electrodes of the lamp.

Another object of the present invention is to provide a power supply for light sources, particularly for fluorescent lamps and the like, that is capable of reducing energy consumption.

Another object of the present invention is to provide a power supply for light sources, particularly for fluorescent lamps and the like, that allows the lamp to operate even if the filaments inside it break.

Another object of the present invention is to provide a power supply for light sources, particularly for fluorescent lamps and the like, usable for normal fluorescent lamps.

Another object of the present invention is to provide a power supply for light sources, particularly for fluorescent lamps and the like, that is highly reliable, relatively easy to manufacture, and at competitive costs.

This aim, these objects, and others which will become apparent hereinafter are achieved by a power supply for light sources, particularly for fluorescent lamps and the like, comprising rectifier means connected to the mains and arranged so as to be able to provide a DC voltage at its output, voltage multiplier means capable of also operate a rectification of the current, so that a multiplied-rectified current output is provided, and a light source, characterized in that both terminals of the DC voltage supplied by the rectifier means are directly connected to respective opposite terminals of said light source, one terminal of said mains being connected via said voltage multiplier to one terminal of said light source, the other terminal of said light source being connected in order to close the multiplied DC current to the return terminal of said rectifier means.

BRIEF DESCRIPTION OF THE DRAWINGS

Further characteristics and advantages of the invention will become apparent from the following detailed description of a preferred but not exclusive embodiment of the device according to the invention, illustrated only by way of non-limitative example in the accompanying drawings, wherein.

DESCRIPTION OF THE PREFERRED EMBODIMENTS

Figure 1:
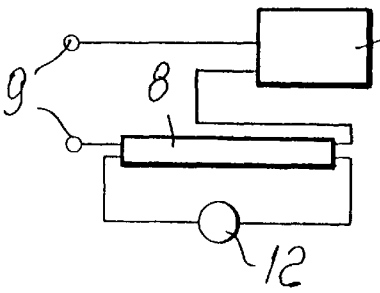
Fig. 1 PRIOR ART
FIG. 1 is a diagram of a conventional power supply for a fluorescent lamp.

FIG. 1 is a view of a conventional solution for supplying power to fluorescent lamps. The reference numeral 8 designates the lamp to be supplied with power, the reference numeral 10 designates the starter, and the reference numeral 12 designates the ballast. The power supply terminals to be connected to the mains are designated by the reference numeral 9.

Figure 2:
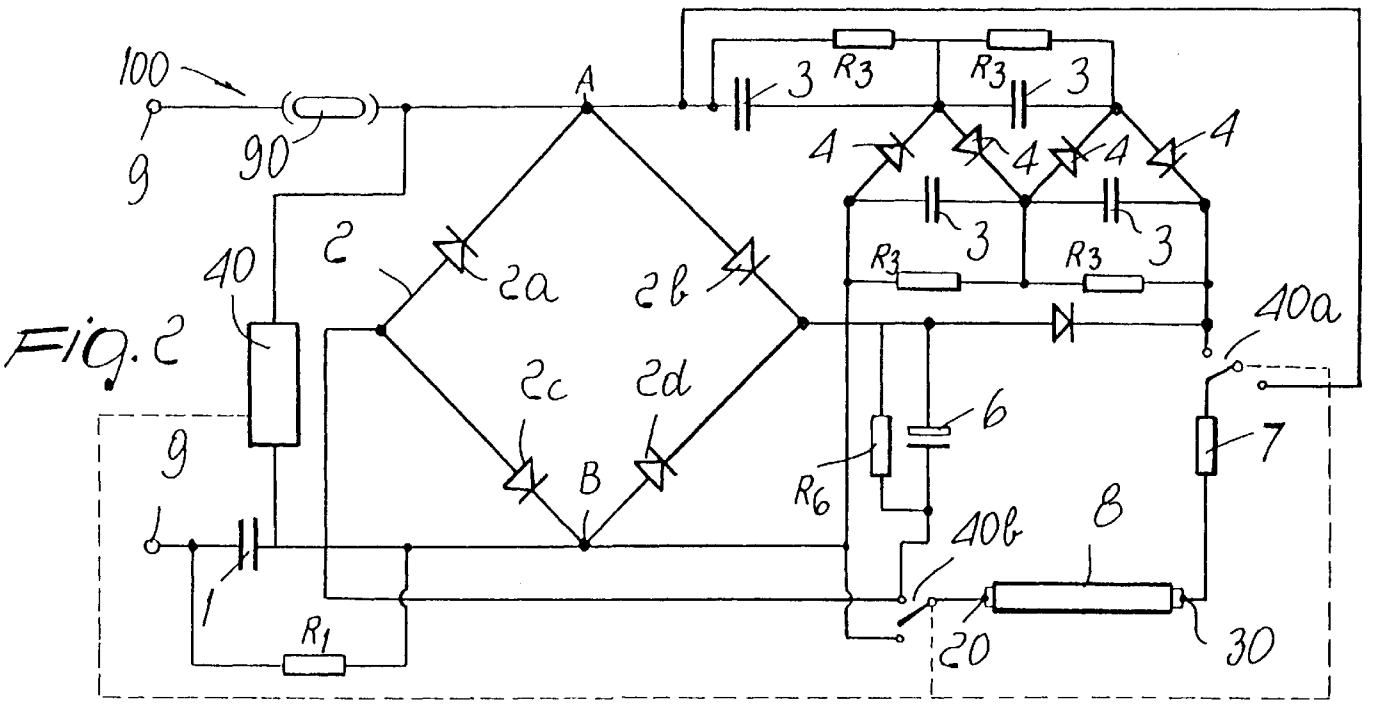
FIG. 2 is a circuit diagram of the device according to the invention.
Figure 3:
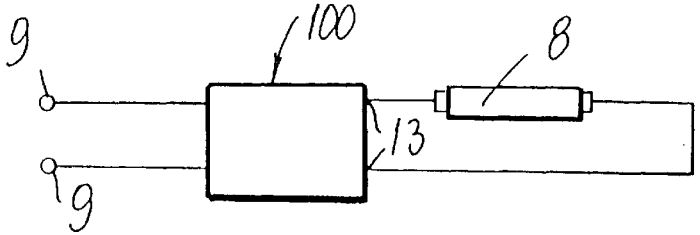
FIG. 3 is a diagram of the connection of the device according to the invention to a fluorescent lamp.

With reference to FIGS. 2 and 3, the device according to the invention, generally designated by the reference numeral 100, comprises first capacitive means, which conveniently comprise a capacitor 1, to which rectifier means 2 are series-connected, said rectifier means advantageously comprising a diode bridge. Said diode bridge is constituted by the diodes 2*a,* 2*b,* 2*c,* and 2*d.*

The rectifier means 2 have the purpose of rectifying the current (voltage) from AC to DC.

Series-connected to one of the two AC mains lines there is a fuse 90 which protects the device against short-circuit. The power of the fuse 90 must be adapted to the maximum current that can be absorbed by the device.

Second capacitive means, which conveniently comprise a capacitor 6 and are adapted to filter the variable component of the current, are series-connected between the output of the rectifier means 2 and a first electrode 20 of the fluorescent lamp 8.

Diode means, which comprise a diode 5, are connected between the output of the rectifier means and a second electrode 30 of the fluorescent lamp 8, after interposing resistive means that comprise a resistor 7.

Voltage multiplier means, constituted by at least one voltage multiplying cell, are connected between the nodes A and B of the rectifier means 2 and the second electrode 30 of the fluorescent lamp 8.

Each voltage multiplying cell comprises diodes 4 and capacitive means 3.

In FIG. 2, the reference numeral 9 designates the voltage supply terminals.

FIG. 3 shows the connection of the circuit according to the invention, shown as a block 100, between the power supply terminals 9 and the fluorescent lamp 8, which is supplied by the output current from the terminals 13 of the device 100.

With reference to FIG. 2, operation of the device according to the invention is as follows.

Ignition of the lamp 8 involves the voltage multiplier means, which rectify and multiply the supply voltage to provide the lamp 8 with a high voltage value that allows its quick ignition without preheating the electrodes 20 and 30 of said lamp.

As a consequence of the quick ignition of the lamp 8, the diode 5 is activated and disconnects the voltage multiplier means for the steady-state supply of power to the lamp 8. At this point, the first capacitive means 1, which act as a ballast and are supplied by the mains, in turn supply the rectifier means 2, the rectified output voltage whereof, appropriately filtered by the capacitor 6, supplies the two electrodes 20 and 30 of the lamp that are shorted.

By using the capacitive ballast 1, the breakage of the tungsten filament inside the lamp 8 does not prevent its operation.

The current rectification and the filtering capacitor 6 allow to power the lamp by using the real peaks of the supply voltage, which otherwise would be unused, thus always supplying the correct voltage value for the lamp.

As shown in FIG. 2, a delay relay 40 is provided which is connected across the mains terminals; this relay 40, once the light source 8 has been ignited by a DC current, allows a delay in order to warm-up the light source 8 by means of a DC current. As soon as this delay has elapsed, the relay 40 actuates its switching contacts 40*a* and 40*b,* disconnecting the voltage rectifier means, the filter means, the voltage multiplier means and the diode means, and connects the light source 8 to the AC mains, in order to avoid the cited disadvantages due to a DC power supply.

Furthermore, in parallel to all capacitors of the device, resistors ($R_1$, $R_3$, $R_6$) are connected in order to discharge the capacitors after the switch-off of light source, so as to allow a quick re-ignition of the light source 8.

In the case of fluorescent tubes supplied in the conventional manner, the device according to the invention allows to rephase the line, replacing the rephasing capacitor that is required if a conventional ballast is used.

In practice it has been observed that the device according to the invention fully achieves the intended aim and objects.

The device thus conceived is susceptible of numerous modifications and variations, all of which are within the scope of the inventive concept; all the details may furthermore be replaced with other technically equivalent elements.

In practice, the materials employed, so long as they are compatible with the specific use, as well as the dimensions, may be any according to the requirements and the state of the art.

What we claim is:

1. A power supply for light sources, particularly for fluorescent lamps and the like, comprising rectifier means connected to the mains and arranged so as to be able to provide a DC voltage at its output, voltage multiplier means capable of also operate a rectification of the current, so that a multiplied-rectified current output is provided, and a light source, wherein both terminals of the DC voltage supplied by the rectifier means are directly connected to respective opposite terminals of said light source, one terminal of said mains being connected via said voltage multiplier to one terminal of said light source, the other terminal of said light source being connected in order to close the multiplied DC current to the return terminal of said rectifier means.

2. A power supply for light sources, particularly fluorescent lamps, according to claim 1, wherein between one terminal of the rectifier means and the related terminal of the light source, means are provided for creating a preferential path for the flow of the DC from the terminal of the rectifier means towards the light source for supplying and thus warming-up said source and keeping it ignited.

3. Device according to claim 1, wherein across the mains terminals a delay relay is connected in order to switch the supply voltage of the light source from DC power supply to AC power supply, shortly after the ignition of said light source.

4. A device according to claim 1, wherein said voltage multiplier means comprise at least one supply voltage multiplier cell, said cell comprising capacitors and diodes.

5. A device according to claim 1, wherein said rectifier means comprise a diode bridge, said diode bridge being connected to the electrodes of said fluorescent lamp.

6. A device according to claim 1, wherein said capacitive means comprise a capacitor that is connected between the output of said rectifier means and a first electrode of said fluorescent lamp.

7. A device according to claim 1, wherein said filtering means comprise a capacitor adapted to eliminate the variable component of said supply voltage, reducing the consequent strobe effect.

8. A device according to claim 7, further comprising resistive means that are connected between the cathode of said diode and a second electrode of said fluorescent lamp, said resistive means limiting the current inside said fluorescent lamp.

9. A device according to claim 4, wherein said fluorescent lamp is of the type where the electrodes are shorted together.

10. Device according to claim 1, wherein there are provided resistive means connected in parallel with the capacitors of said device, in order to allow the discharge of said capacitors after the switch-off of said light source.

11. Device according to claim 1, wherein a fuse is provided in series on the lead stemming from one of the terminals of the mains.

* * * * *